United States Patent [19]

Goans et al.

[11] Patent Number: 4,552,222

[45] Date of Patent: Nov. 12, 1985

[54] FUSIBLE-ELEMENTS HOLDER BRACKET DEVICE

[76] Inventors: Kip B. Goans, 2576 Appolo Ave.; Ruel R. Gober, Jr., 3525 Lake Catherine Dr., both of Harvey, La. 70058

[21] Appl. No.: 645,330

[22] Filed: Aug. 29, 1984

[51] Int. Cl.[4] ..... A62C 37/12

[52] U.S. Cl. ..... 169/57; 169/42; 248/74.5

[58] Field of Search ..... 169/42, 57, 58; 248/74.5; 49/7, 8, 477

[56] References Cited

U.S. PATENT DOCUMENTS

| | | | |
|---|---|---|---|
| 1,365,629 | 1/1921 | Lieb | 248/74.5 |
| 2,250,787 | 5/1941 | Anderson | 49/7 |
| 2,800,187 | 6/1957 | Lehder | 169/42 |

*Primary Examiner*—Andres Kashnikow
*Assistant Examiner*—Scott D. Malpede
*Attorney, Agent, or Firm*—James B. Lake, Jr.

[57] ABSTRACT

A heat activated device having a plurality of fusible elements for mounting in an aperture of a pressure fluid line which holds inactive safety fire control system which is actuated by loss of pressure in the pressure fluid line. The melting of any or all of the fusible elements at a preselected rise in temperature vents fluid pressure from the mounting aperture.

11 Claims, 4 Drawing Figures

FUSIBLE-ELEMENTS HOLDER BRACKET DEVICE

BACKGROUND OF THE INVENTION

The invention relates generally to fusible-plugholders, and more particularly to a fusible-element holder bracket device.

It is well known in the prior art for fusible-plug holders in the form of pipe or tube "T" fittings to have been connected in pressure fluid lines by oppositely disposed ends with the third end, normal to a common axis of said two ends, closed by a fusible plug. Such plug holders are used to vent fluid pressure in a line, in which it is connected, to atmosphere upon a predetermined rise in temperature over a set time period, and thereby activate any pressure monitored safety system. Their use required severing a fluid pressure line and sealing the two connections of the "T" fitting holder to the cut ends of the pressure line, which is supported by other means, to provide only one fusible plug per fitting against a possible failure in a much more reliable pressure monitored system.

The invention teaches a fusible-elements holder bracket device that includes a plurality of different fusible elements, rather than only one of a single kind, requires one sealed connection, rather than two, to install for use, and connects to and in, and where possible is supportable of, a pressure fluid line without severing it.

SUMMARY OF THE INVENTION

It is an object of the invention to provide a fusible elements holder bracket device that more nearly equates a possibility of failure of the device to that of the pressure monitored system it activates.

Another object of the invention is to provide a fusible elements holder bracket device that fixes the device in a pressure fluid line and said line to a supporting structure.

The invention is more fully described below and more particularly pointed out in the claims.

DETAILED DESCRIPTION OF THE PREFERRED EMBODIMENTS

The invention is described in use with a pressure monitored fire control safety system, but it should be understood that it is just as usable with any pressure monitored safety system.

Figure 1:
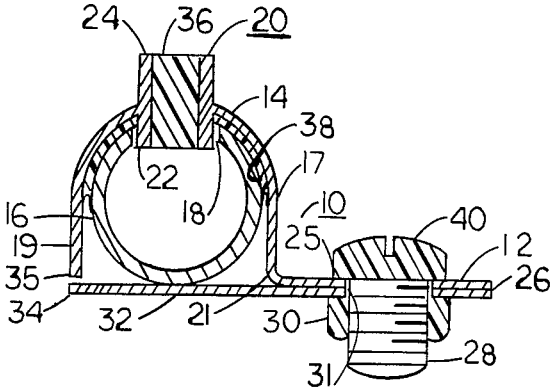
FIG. 1 is a cross-sectional view of a first embodiment of the invention taken along section lines 1—1 of FIG. 2.
Figure 2:
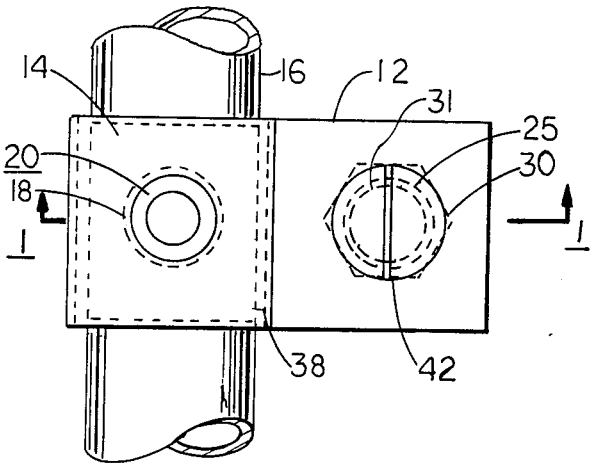
FIG. 2 is a plan view of the first embodiment.

Referring to FIGS. 1 and 2, the first embodiment of the invention comprises a body 10 having a flat part 12 and a curved part 14 for respectively conforming to any flat supporting structure and a rounded upper surface of a pressure fluid line 16 defining a side opening 18. A pair of straight extentions 17 and 19 to the respective ends of curved part 15 are normal to flat part 12 and with extension 17 also contiguous with flat part 12, forming therewith a 90 degree angle 21. The extensions equate and limit engaging pressure of strap 10 on the pressure fluid line 16. A hollow open-ended cylinder 20 is integral with, and extends normal to, and above and below said curved part 14, for the lower end 22 of said cylinder to extend through and connect with said side opening 18 in said pressure fluid line, and the upper end 24 to extend to atmosphere. Strap flat part 12 defines a bolt hole 25 adjacent a free end 26 thereof for fixing strap 10 to any flat surface. A bolt 28 and nut 30 is adapted to bolt the invention to any flat surfaced supporting structure through said bolt hole 25 and a registering hole 31 in said structure, and with said cylinder lower end 22 registering in opening 18 of line 16. Supporting structure as shown in FIGS. 1 and 2 is a flat plate 32 extending between oppositely disposed ends 26 and 34 of body 10, but the structure could be any wall (not shown) available. A plurality of fusible elements provided by the invention comprise a fusible plug 36 mounted in hollow cylinder 20 for closing both said ends 22 and 24 at less then fusible temperatures, a fusible gasket 38 for sealing the connection of said cylinder to and in pressure fluid line 16 at less than fusible temperatures, and fusible bolt head 40 and fusible nut 30 of the bolt and nut for rigidly fixing the invention to the pressure pipe line and the supporting structure also at less than fusible temperatures. The melting of any of the fusible elements will cause the device to vent pressure fluid from line 16 to atmosphere. The first embodiment fusible elements are all eutetic alloy. Extension 19 of strap means 12 terminates in a free end 35 and does not engage flat plate 32 or other supporting structure if used.

Figure 3:
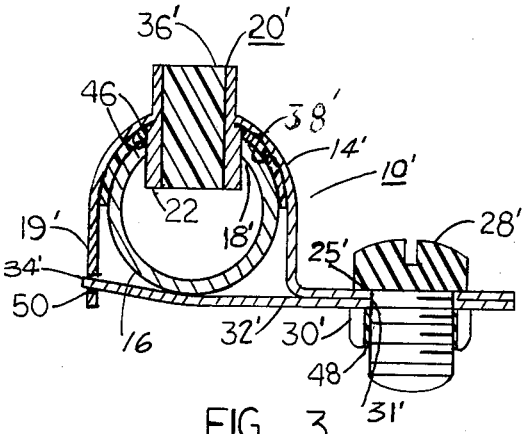
FIG. 3 is a cross sectional view of the second embodiment of the invention taken along section lines 3—3 of FIG. 4.
Figure 4:
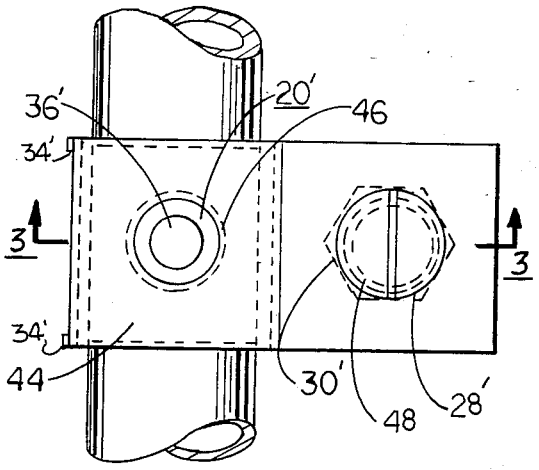
FIG. 4 is a plan view of the second embodiment.

Referring to FIGS. 3 and 4, the second embodiment of the invention resembles the first, differing only in having a longer straight extension 19' for defining near a free end a hole hole 50 for engaging a free end 34' of tensilely bendable flat plate 32' for clamping said body 10' around said pressure fluid line and said hollow cylinder 20' lower end 22 in said side opening 18. Second embodiment fusible elements comprise a fusible plug 36' of eutectic alloy as in the first, a fusible gasket 38' of fusible elastomeric coated with an adhesive plastic 46, also fusible, for ease in field installation, and a fusible plastic insert 48 in nut 30'.

In use, the first embodiment eutectic sealing gasket 38 of FIG. 1 is pressed over the lower end 22 of cylinder 20 and around the concave inner surface of strap curved part 14 and the convex surface of pressure fluid line 16, to fit therebetween and seal said end 20 in said side opening side opening 18 of line 16. Fusible plug 36 is mounted in said hollow cylinder 20, and bolt 28 with a fusible head 40 is engaged through registering bolt holes 25 and 31 with fusible nut 30, thereby fixing the invention in place for heat monitoring said pressure fluid line 16 to remain inactive so long as ambient temperature did not rise above the selected fusible temperature of the fusible elements. Above said selected temperature, the fusible elements melt together or in any sequence to vent pressure fluid from the pressure fluid line to activate said fire control safety system.

In use, the second embodiment with fusible elements differing little from those of the first embodiment, and then only in slightly less complicated arrangement, is secured on a tensile backing plate 30' at both ends of said body 10' respectively by engaging in hole 50 of straight extension 19' and by a bolt 28' and nut 30' in registering holes 25 and 31 in said back plate and strap. Securing body 10' at both ends equalizes the retaining pressure of the invention to and in the pressure fluid line 16.

What is claimed is:

1. In a fire protection system having a monitoring pressure fluid line for holding deactivated activating means of a fire control safety system, a fusible elements holder bracket device for venting fluid pressure in said line to atmosphere at a preselected rise in temperature to activate said system, comprising:

(a) a body means integral with a hollow open ended cylinder means, said body means being flat in part for attaching to supporting structure, and sequentially curved upwardly in part to an apex and down for estending partially around said pressure fluid line, and said hollow open ended cylinder means being normal to said upward curve and apex and extending therebelow and above respectively into said pressure fluid line side opening and to atmosphere;

(b) a plurality of connecting means for attaching said means flat part to said supporting structure and to said pressure fluid line with said lower end of said cylinder means extending through said side opening into said line; and (c) a plurality of fusible element means, one said means mounted in said hollow open ended cylinder means for closing said ends, second said means mounted between said body means curved part and said pressure fluid line for sealing said one connection of said cylinder end in said line, and a third said means mounted as part of said connecting means for attaching said body means to to said supporting structure, and all for melting at a preselected temperature.

2. A fusible elements holder bracket device as described in claim 1 wherein said supporting structure is flat, straight and at least the length of said body means.

3. A supporting structure as described in claim 2 comprises a rigid plate having oppositely disposed ends and attached by one said end to said flat part of said body means.

4. A supporting structure as described in claim 2 comprises: a tensile plate having oppositely disposed ends bendably fixed to said body means by both said ends for clamping said pressure fluid line therebetween and biasing said cylinder means lower end into said side opening in said line.

5. A fusible elements holder bracket device as described in claim 1 wherein said connecting means for attaching said body means to said supporting structure comprises a bolt and nut engaging through registering holes defined respectively thereby in adjacent flat ends thereof.

6. Connecting means for attaching said body means to said supporting structure as described in claim 5 wherein a projection of said supporting structure's free end registers in a hole defined in said body means end normal to said free end.

7. A fusible elements holder bracket device as described in claim 1 wherein said fusible element means comprise a fusible plug for said hollow cylinder means, a fusible gasket for sealing said connection between said cylinder means lower end and said pressure fluid line, and fusible parts of said connecting means for attaching said body means to said supporting structure.

8. Fusible element means as described in claim 7, wherein said plug comprises eutectic alloy means for press fitting in said hollow cylinder means.

9. Fusible elements as described in claim 7 wherein said fusible gasket comprises a fusible elastomeric coated with a fusible adhesive plastic for ease of assembly in operational position.

10. Fusible element means as described in claim 7 wherein said fusible parts of said connecting means comprise a bolt head and connecting nut of eutectic alloy.

11. Fusible element means as described in claim 7 wherein said fusible parts of said connecting means comprises a fusible plastic insert in a nut.

* * * * *